US006638371B1

(12) United States Patent
Mochida et al.

(10) Patent No.: US 6,638,371 B1
(45) Date of Patent: Oct. 28, 2003

(54) COLD-ROLLED STEEL SHEET HAVING ULTRAFINE GRAIN STRUCTURE AND METHOD FOR MANUFACTURING THE SAME

(75) Inventors: Tetsuo Mochida, Chiba (JP); Kazuhiro Seto, Chiba (JP); Kei Sakata, Chiba (JP); Tomohisa Oonishi, Chiba (JP)

(73) Assignee: Kawasaki Steel Corporation, Kobe (JP)

( * ) Notice: Subject to any disclaimer, the term of this patent is extended or adjusted under 35 U.S.C. 154(b) by 0 days.

(21) Appl. No.: 10/389,912

(22) Filed: Mar. 18, 2003

(30) Foreign Application Priority Data

Mar. 29, 2002 (JP) ..... 2002-094065
Aug. 1, 2002 (JP) ..... 2002-224617

(51) Int. Cl.[7] ..... C21D 8/00; C22C 38/04; C22C 38/12; C22C 38/14

(52) U.S. Cl. ..... 148/320; 148/336; 148/652

(58) Field of Search ..... 148/320, 336, 148/333, 334, 335, 652

(56) References Cited

U.S. PATENT DOCUMENTS 5,074,926 A * 12/1991 Tosaka et al. ..... 148/333
5,582,658 A 12/1996 Masui et al.

FOREIGN PATENT DOCUMENTS

| | | |
|---|---|---|
| EP | 0 922 782 A1 | 6/1999 |
| EP | 0 945 522 A1 | 9/1999 |
| EP | 0 974 677 A1 | 1/2000 |
| EP | 1 264 911 A2 | 12/2002 |
| JP | 53-123823 | 10/1978 |
| JP | 2-301540 | 12/1990 |
| JP | 2-5-65564 | 9/1993 |

* cited by examiner

*Primary Examiner*—Deborah Yee
(74) *Attorney, Agent, or Firm*—Oliff & Berridge PLC

(57) ABSTRACT

A cold-rolled steel sheet having an ultrafine grain structure including a ferrite phase provided. The cold-rolled steel sheet contains C, Si, Mn, Ni, Ti, Nb, Al, P, S, N and Fe and incidental impurities. The ferrite phase has a content of 65 percent by volume or more and an average grain size of 3.5 μm or less.

14 Claims, 2 Drawing Sheets

COLD-ROLLED STEEL SHEET HAVING ULTRAFINE GRAIN STRUCTURE AND METHOD FOR MANUFACTURING THE SAME

BACKGROUND OF THE INVENTION

1. Field of Invention

The present invention relates to cold rolled steel sheet suitably used for automobiles, household electrical appliances, and machinery, and particularly to a high tensile cold-rolled steel sheet having an ultrafine grain structure and exhibiting excellent characteristics including strength, ductility, toughness, strength-ductility balance, and stretch flangeability.

2. Description of Related Art

Steel sheets used for automobiles, household electrical appliances, and machinery are required to have excellent mechanical properties, such as strength, formability, and toughness. In order to enhance these mechanical characteristics comprehensively, it is effective to make the grain of the steel fine. Accordingly, many methods have been proposed for achieving an ultrafine grain structure.

As for high tensile steel sheets, it has recently been desired to manufacture a high functional steel sheet at a low cost. In particular, steel sheets for-automotive application are desired to have impact resistance as well as high strength, from the viewpoint of the protection of occupants in a crash.

Moreover, automotive steel sheets are required to have excellent press formability because many of them are press-formed into automotive parts. In addition, members and reinforcements for enhancing the strength of automobile bodies are often formed through the use of stretch flange formation. Accordingly, steel sheets for these automotive applications are highly desired to have excellent stretch flangeability as well as high strength.

According to these circumstances, grain fining of a high tensile steel is a challenge with the goal of preventing degradation of ductility, toughness, durability, and stretch flangeability, which are degraded as tensile strength becomes higher.

Large-reducing rolling, controlled rolling, controlled cooling, and the like have been known as methods for grain fining. As for large-reducing rolling, some methods for grain fining are disclosed in which austenite grains are subjected to large deformation to promote $\gamma$-$\alpha$ strain induced transformation, in Japanese Unexamined Patent Application Publication No. 53-123823 and Japanese Examined Patent Application Publication No. 5-65564, and others.

A precipitation strengthened steel sheet containing Nb or Ti is an example of application of controlled rolling and controlled cooling. This type of steel sheet is produced by making use of precipitation strengthening effect of Nb or Ti to increase the strength of the steel and, further, by making use of recrystallization suppressing effect of Nb or Ti so that $\gamma$-$\alpha$ strain induced transformation of non-crystallized deformed austenite grains reduces the grain size of ferrite crystal grains.

In addition, a method for producing a structure mainly containing isotropic ferrite has been disclosed in Japanese Unexamined Patent Application Publication No.2-301540. According to this method, part or the whole of a steel material partially containing ferrite is inversely transformed to austenite having an ultrafine grain size by heating the steel material to a temperature of the transformation point ($Ac_1$ point) or more while being subjected to plastic deformation, or by heating the steel material and subsequently allowing it to stand at a temperature of $Ac_1$ point or more for a predetermined period of time. Then, the resulting fine austenite grains are transformed to ferrite during subsequent cooling, thus resulting in a structure mainly containing isotropic ferrite grains having an average grain size of 5 $\mu$m or less.

All of the techniques described above are intended for use in a hot-rolling process, that is, intended to reduce the grain size of a hot rolled steel sheet.

However, very few techniques for cold-rolled steel sheets are known, which have a thickness smaller than that of hot-rolled steel sheets and are required to have highly precise thickness and surface properties or subjected to galvanization or tinning, and in which the grain size is reduced in a conventional cold-rolling and annealing process.

A dual phase steel sheet having a combined structure of ferrite and martensite is typically known as a high-strength steel sheet with excellent formability.

Also, a highly ductile steel sheet utilizing transformation induced plasticity resulting from retained austenite is going into practical use.

These steel sheets hardened by hard second phase have high elongationability. However, the steel structure has a large difference between the hardnesses of ferrite, acting as the matrix thereof, and hard martensite (retained austenite also transforms into martensite in the deformation), acting as a major strengthening factor therein. This large hardness difference can cause voids and reduce the local elongation, thus deteriorating the stretch flangeability.

SUMMARY OF THE INVENTION

Accordingly, an object of the present invention is to provide a cold-rolled steel sheet having an ultrafine grain structure which is used for automobiles, household electrical appliances, and machinery, and a method for advantageously manufacturing the same. The cold-rolled steel sheet of the present invention is enhanced in the strength, ductility, toughness, strength-ductility balance and stretch flangeability by reducing the grain size thereof.

The inventors of the present invention have carried out intensive research to accomplish the object, and consequently, have obtained an ultrafine grain structure having an average grain size of 3.5 $\mu$m or less by controlling the recrystallization temperature and $A_1$ and $A_3$ transformation temperatures of a steel sheet whose metal contents have been appropriately controlled, and then by controlling the recrystallization annealing temperature after cold-rolling and the cooling rate after the recrystallization annealing. Also, the inventors have found that the stretch flangeability of the resulting steel sheet can be extremely enhanced by optimizing the secondary phase of the steel structure.

Accordingly, the present invention is directed to a cold-rolled steel sheet having an ultrafine grain structure including a ferrite phase. The cold-rolled steel sheet includes: 0.03 to 0.16 mass percent of C; 2.0 mass percent or less of Si; at least one of 3.0 mass percent or less of Mn and 3.0 mass percent or less of Ni; at least one of 0.2 mass percent or less of Ti and 0.2 mass percent or less of Nb; 0.01 to 0.1 mass percent of Al; 0.1 mass percent or less of P; 0.02 mass percent or less of S; 0.005 mass percent or less of N; and Fe and incidental impurities. The ferrite phase has a content of 65 percent by volume or more and an average grain size of 3.5 μm or less. The C, Si, Mn, Ni, Ti, and Nb satisfy expressions (1), (2), and (3):

$$637.5+4930(Ti^*+(48/93)\cdot[\%Nb])>A_1 \quad (1)$$

$$A_3<860 \quad (2)$$

$$[\%Mn]+[\%Ni]>1.3 \quad (3)$$

where $$Ti^*=[\%Ti]-(48/32)\cdot[\%S]-(48/14)\cdot[\%N] \quad (4)$$

$$A_1=727+14[\%Si]-28.4[\%Mn]-21.6[\%Ni] \quad (5)$$

$$A_3=920+612.8[\%C]^2-507.7[\%C]+9.8[\%Si]^3-9.5[\%Si]^2+68.5[\%Si]+2[\%Mn]^2-38[\%Mn]+2.8[\%Ni]^2-38.6[\%Ni]+102[\%Ti]+51.7[\%Nb] \quad (6)$$

[%M] represents element M content. (mass %)

Preferably, a remainder content of the steel sheet, other than the ferrite phase, is limited to 3 percent by volume or less except for bainite.

Preferably, the cold-rolled steel sheet further includes at least one of 1.0 mass percent or less of Mo and 1.0 mass percent or less of Cr.

Preferably, the cold-rolled steel sheet further includes at least one element selected from the group consisting of Ca, rare earth elements, and B in a total amount of 0.005 mass percent or less.

The present invention is also directed to a method for manufacturing a cold-rolled steel sheet having an ultrafine grain structure. The method includes: reheating a starting steel material to a temperature of 1200° C. or more; hot-rolling the starting steel material; cold-rolling the hot-rolled material; performing recrystallization annealing at a temperature in the range of $A_3$° C. to ($A_3$+30)° C.; and cooling the annealed material to 600° C. or less at a rate of 5° C./s or more. The starting steel material includes: 0.03 to 0.16 mass percent of C; 2.0 mass percent or less of Si; at least one of 3.0 mass percent or less of Mn and 3.0 mass percent or less of Ni; at least one of 0.2 mass percent or less of Ti and 0.2 mass percent or less of Nb; 0.01 to 0.1 mass percent of Al; 0.1 mass percent or less of P; 0.02 mass percent or less of S; 0.005 mass percent or less of N; and Fe and incidental impurities. The C, Si, Mn, Ni, Ti, and Nb satisfy expressions (1), (2), and (3):

$$637.5+4930(Ti^*+(48/93)\cdot[\%Nb])>A_1 \quad (1)$$

$$A_3<860 \quad (2)$$

$$[\%Mn]+[\%Ni]>1.3 \quad (3)$$

where $$Ti^*=[\%Ti]-(48/32)\cdot[\%S]-(48/14)\cdot[\%N] \quad (4)$$

$$A_1=727+14[\%Si]-28.4[\%Mn]-21.6[\%Ni] \quad (5)$$

$$A_3=920+612.8[\%C]^2507.7[\%C]+9.8[\%Si]^3-9.5[\%Si]^2+68.5[\%Si]+2[\%Mn]^2-38[\%Mn]+2.8[\%Ni]^2-38.6[\%Ni]+102[\%Ti]+51.7[\%Nb] \quad (6)$$

[%M] represents element M content. (mass %)

Preferably, the method includes further cooling the cooled material from 500 to 350° C. for a period of time in the range of 30 to 400 s, after cooling the material to 600° C. or less at a rate of 5° C./s or more.

Preferably, the starting steel material further includes at least one of 1.0 mass percent or less of Mo and 1.0 mass percent or less of Cr.

Preferably, the starting steel material further includes at least one element selected from the group consisting of Ca, rare earth elements, and B in a total amount of 0.005 mass percent or less.

According to the present invention, a high tensile steel sheet having an ultrafine grain structure and exhibiting excellent mechanical properties, and particularly strength-elongation balance, toughness, and stretch flangeability, can advantageously manufactured stably without extensively modifying equipment.

$$637.5+4930(Ti^*+(48/93)\cdot[\%Nb])>A_1.$$

DETAILED DESCRIPTION OF PREFERRED EMBODIMENTS

Figure 1:
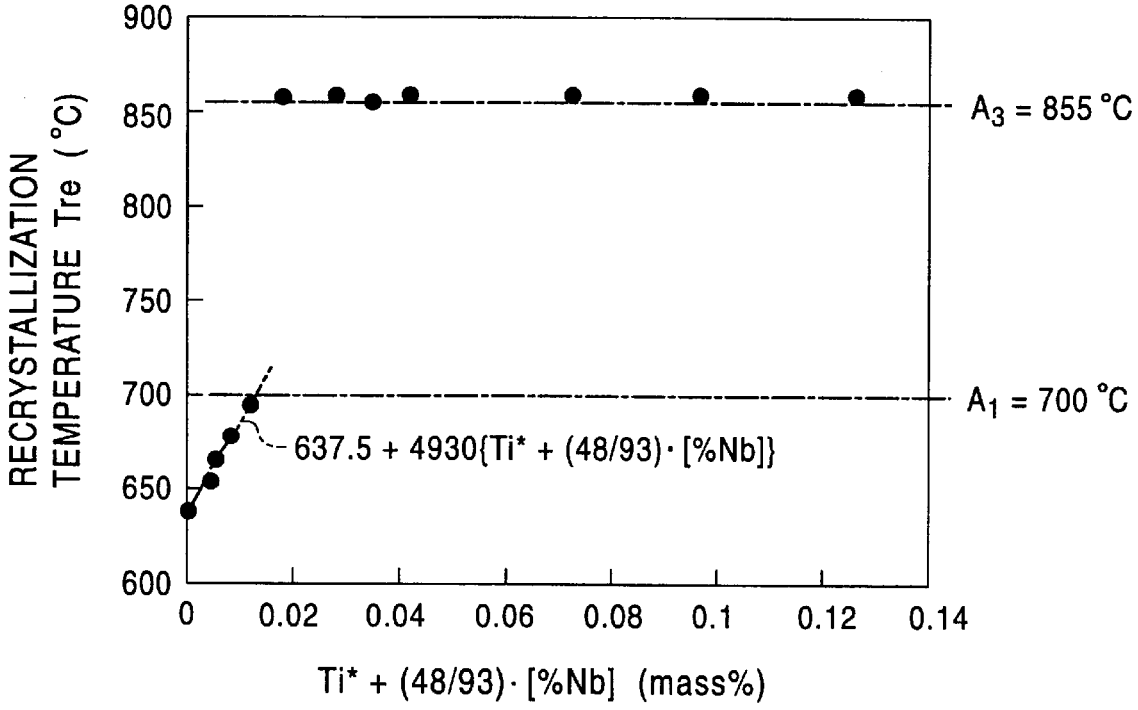
FIG. 1 is an exemplary graph showing the relationship between the Ti and Nb contents and recrystallization temperature Tre of a steel composition in which temperatures $A_1$ and $A_3$ are adjusted to 700° C. and 855° C., respectively.

The present invention will now be illustrated in detail.

First, the steel composition used in the invention will be described. Percent or % herein represents mass percent unless otherwise stated.

C: 0.03 to 0.16%

C not only serves as a stable strengthening element but also contributes to the formation of a low-temperature transformed phase, such as pearlite or bainite, effectively. While a C content of less than 0.03% shows less effect, a C content of more than 0.16% leads to deterioration of ductility and weldability. Therefore, the C content is set in the range of 0.03 to 0.16%.

Si: 2.0% or less

Si is effective as a solid solution strengthening element to improve the strength-elongation balance. However, excessive amount of Si leads to deteriorate ductility, surface properties, and weldability. Therefore, the Si content is limited to 2.0%, and it is preferably in the range of 0.01 to 0.6%.

Mn: 3.0% or less and/or Ni: 3.0% or less

Mn and Ni are austenite former and have an effect of lowering the $A_1$ and $A_3$ transformation temperatures, which contributes to grain fining. These elements also promote the formation of a secondary phase, thereby increasing the strength-ductility balance. However, an excessive amount of Mn or Ni hardens the resulting steel and, thus, degrades the strength-ductility balance. Accordingly, at least one of 3.0% or less of Mn and 3.0% or less of Ni is added.

In addition, Mn converts harmful dissolved S to harmless MnS, and is preferably added in an amount of 0.1% or more. Also, it is preferable to add 0.01% or more of Ni.

Ti: 0.2% or less and/or Nb: 0.2% or less

By adding Ti or Nb, TiC or NbC is precipitated, thus increasing the recrystallization temperature of the steel sheet. Preferably, 0.01% or more of Ti or Nb is added, and they may be added singly or in combination. However, 0.2% or more of Ti or Nb does not produce more effects, and besides, it leads to degrading the ductility of the ferrite. Accordingly, the Ti and Nb contents are each limited to 0.2% or less.

Al: 0.01 to 0.1%

Al is effective for deoxidation of steel and improving the cleanliness of the steel. Preferably, Al is added during deoxidation in steelmaking process. While less than 0.01% of Al produces less effect, more than 0.1% of Al does not produce more effect and increases a manufacturing cost. Accordingly, the Al content is set in the range of 0.01 to 0.1%.

P: 0.1% or less

P enhances the strength effectively at a low cost without degrading the ductility. However, an excessive amount of P degrades the formability and the toughness, and accordingly, the P content is limited to 0.1%. When more enhanced formability and toughness are required, it is preferable to reduce the Pcontent to 0.02% or less. There is no lower limit, but, preferably, the lower limit of the P content is 0.0001% when manufacturing costs are considered.

S: 0.02% or less

S causes hot tears during hot rolling. In addition, S contained in MnS in a steel sheet degrades the ductility and the stretch flangeability. Accordingly, it is preferable to reduce the S content as much as possible. However, a content of 0.02% or less is acceptable and the S content is determined to be 0.02% or less in the present invention. When manufacturing costs are considered, a S content of 0.0001% or more is preferable.

N: 0.005% or less

N causes degrading of the ductility and yield elongation under aging at room temperature, and accordingly, the N content is limited to 0.005%. However, when manufacturing costs are considered, a N content of 0.00001% or more is preferable.

In addition to the elements described above, the following elements may be added, if necessary.

Mo: 1.0% or less and/or Cr 1.0% or less

Mo and Cr may be added to serve as strengthening elements, if necessary, but an excessive amount of them degrades the strength-ductility balance. Preferably, the Mo and Cr contents are each limited to 1.0% or less. In order to sufficiently enhance the effects as strengthening elements, the Mo and Cr contents are, preferably, each 0.01% or more.

Ca, REMs, and B: 0.005% or less in total

Ca, rare earth elements (REM), and B help control the form of sulfide and increase the grain boundary strength, consequently improving the formability. Hence, they may be added when necessary. However, excessive amounts of them could undesirably increase inclusions in the molten steel during a refining process, and accordingly, it is preferable to limit the total amount to 0.005% or less. In order to ensure the effects of these elements, at least one element selected from the group consisting of Ca, REMs, and B is, preferably, added in an amount of 0.0005% or more.

In addition to satisfying the above-described requirements for the composition of the steel sheet, C, Si, Mn, Ni, Ti, and Nb must satisfy following expressions (1), (2), and (3):

$$637.5+4930(Ti^*+(48/93)\cdot[\%Nb])>A_1 \quad (1)$$

$$A_3<860 \quad (2)$$

$$[\%Mn]+[\%Ni]>1.3 \quad (3)$$

where $$Ti^*=[\%Ti]-(48/32)\cdot[\%S]-(48/14)\cdot[\%N] \quad (4)$$

$$A_1=727+14[\%Si]-28.4[\%Mn]-21.6[\%Ni] \quad (5)$$

$$A_3=920+612.8[\%C]^2-507.7[\%C]+9.8[\%Si]^3-9.5[\%Si]^2+68.5[\%Si]+2[\%Mn]^2-38[\%Mn]+2.8[\%Ni]^2-38.6[\%Ni]+102[\%Ti]+51.7[\%Nb] \quad (6)$$

[%M] here represents element M content. (mass %)

$A_1$ and $A_3$ are predicted values of the $A_{C1}$ transformation temperature (° C.) and $A_{C3}$ transformation temperature (° C.) of the steel, respectively, and are derived from the regression equation according to the results of experiments the inventors performed. These predicted temperatures $A_1$ and $A_3$ are suitably adopted when the steel is heated at a rate in the range of 2 to 20° C./s.

The reason for expressions (1), (2), and (3) will now be described.

Expression (1) specifies the Ti and Nb contents.

It is generally known that addition of Ti or Nb results in precipitation of TiC or NbC, consequently increasing the recrystallization temperature of the steel sheet. The inventors investigated the relationship between the Ti and Nb contents and recrystallization temperature Tre, and found that, when specific amounts or more of Ti and Nb are added, recrystallization temperature Tre becomes equal to $A_3$ derived from expression (6).

FIG. 1 shows the relationship between the Ti and Nb contents and recrystallization temperature Tre of a steel composition which is adjusted so that temperatures $A_1$ and $A_3$ are about 700° C. and about 855° C., respectively. Recrystallization temperature Tre is determined according to the experiment of measuring the hardness and observing the steel structure through laboratory simulation of continuous annealing process at varied heating temperatures.

FIG. 1 shows that recrystallization temperature Tre rapidly increases to about 855° C., that is, $A_3$, and is saturated immediately as the value of $637.5+4930(Ti^*+(48/93)\cdot[\%Nb])$ increases beyond $A_1$, that is, 700° C.

Figure 2:
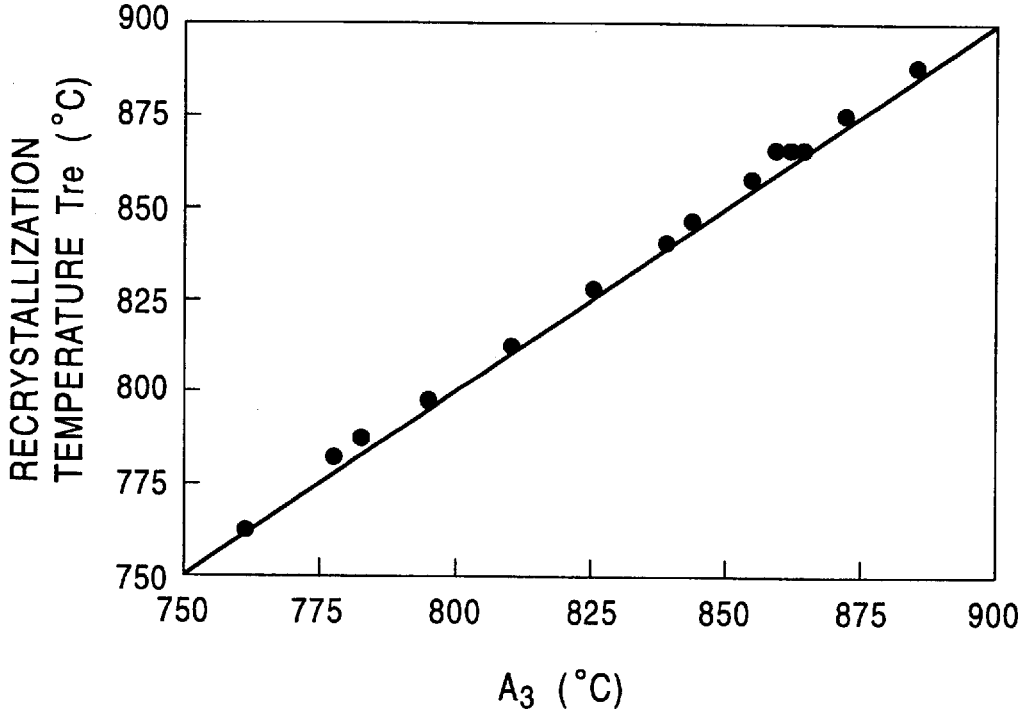
FIG. 2 is an exemplary graph showing the relationship between temperature $A_3$ and recrystallization temperature Tre under the conditions satisfying the expression.

FIG. 2 shows the relationship between temperature $A_3$ and recrystallization temperature Tre under the conditions satisfying expression (1): $637.5+4930(Ti^*+(48/93)\cdot[\%Nb])>A_1$. Temperature $A_3$ here is varied by varying the C, Si, Mn, and Ni contents and other contents.

As shown in FIG. 2, recrystallization temperature Tre becomes almost equal to $A_3$ under the conditions satisfying expression (1): $637.5+4930(Ti^*+(48/93)\cdot[\%Nb])>A_1$.

The reason may be considered as follows.

When the recrystallization temperature is increased by the pinning force of the C or N-compounds and complex compounds with Ti and Nb added and, thus, recrystallization did not occur in the ferrite ($\alpha$) region lower than $A_1$, the recrystallization temperature reaches a temperature in the ferrite-austenite ($\gamma$) dual phase region, with non-recrystallized deformed $\alpha$. As a result, nucleation of recrystallized $\alpha$ in the deformed $\alpha$ and nucleation of $\alpha$-to-$\gamma$ transformation occur simultaneously. In this instance, driving force of $\gamma$ transformation is larger than that of $\alpha$ recrystallization, and therefore, the nucleation of $\gamma$ transformation precedes the nucleation of recrystallized $\alpha$, and thus $\gamma$ nucleuses occupy precedent nucleation sites.

The atomic rearrangement in the $\gamma$ transformation corrects dislocation, and only the deformed $\gamma$ having a low dislocation density remains, thus making it further difficult to recrystallizing the deformed $\alpha$. When the temperature increases to more than $A_3$ to reach the $\gamma$ single phase region, dislocation completely vanishes at last, and seemingly completes recrystallization. This is considered as the mechanism of agreeing the recrystallization temperature with $A_3$ and saturating.

Since the nucleation of the $\alpha$-to-$\gamma$ transformation occurs in the deformed $\alpha$ (having many precedent nucleation sites), the size of $\gamma$ grains at a temperature at which recrystallization is completed is reduced. It is, therefore, effective to set the recrystallization temperature at $A_3$ in order to reduce the $\gamma$ grain size at high temperature during annealing. Thus, Ti and Nb are added in an amount satisfying expression (1).

Expression (2) specifies $A_3$.

As described above, $A_3$ refers substantial recrystallization temperature. In the case of satisfying expression (1), it is necessary to perform recrystallization annealing at a temperature of $A_3$ or more. However, when $A_3$ is 860° C. or more, the recrystallization annealing must be performed at a high temperature. Consequently γ grains significantly grow and, thus, ultrafine grains having an average grain size of 3.5 μm or less do not obtained. Accordingly, Expression $A_3$<860° C. must be satisfied, and $A_3$<830° C. is preferable.

Expression (3) specifies contents of elements for austenite former, that is, Mn and Ni.

By increasing the contents of austenite former elements, the ferrite transformation line in a continuous cooling transformation (CCT) diagram is shifted to the low temperature side. Consequently, the degree of undercooling is increased in γ-to-α transformation during a cooling process after annealing to generate ultrafine nucleuses in α, and thus α grains become ultrafine. Accordingly, expression (3) [%Mn]+[%Ni]>1.3% must be satisfied in addition to expressions (1) and (2), in order to obtain ultrafine grains having an average grain size of 3.5 μm or less.

Mn and Ni may be added singly or in combination, as long as expression (3) [%Mn]+[%Ni]>1.3% is satisfied. More preferably [%Mn]+[%Ni]≧1.5% and still preferably [%Mn]+[%Ni]≧2.0% are satisfied.

The steel structure will now be described.

The steel structure of the present invention includes 65% by volume or more of a ferrite phase and the average grain size of the ferrite is 3.5 μm or less.

This is because, in order to obtain a cold-rolled steel sheet having excellent strength, ductility, toughness, and strength-elongation balance, the sheet structure must be substantially composed of fine ferrite. In particular, it is important for the steel structure to include 65% by volume or more of a fine ferrite phase having an average grain size of 3.5 μm or less.

An average ferrite grain size of more than 3.5 μm results in degraded strength-elongation balance and toughness, and a soft ferrite content in the steel structure of less than 65% by volume seriously degrades the ductility and thus leads to degraded formability.

Martensite, bainite, and pearlite may form a secondary phase other than the ferrite phase, in the steel structure.

When stretch flangeability is required, the steel structure may be composed of a ferrite single phase, or include a secondary phase other than the ferrite phase. However, if the difference between the hardnesses of the ferrite matrix and the remainder is large, voids are liable to occur in the remainder of the steel structure during processes. Preferably, the remainder is composed of bainite, whose hardness has a small difference from that of the ferrite matrix.

If phases other than ferrite and bainite, such as martensite and pearlite, are present in a large amount, the hardness difference from the ferrite matrix becomes larger, or those phases adversely affect the stretch flangeability and degrade it. However, a content of 3% by volume or less of phases other than ferrite and bainite is acceptable.

Accordingly, when excellent stretch flangeability is particularly required, the steel structure includes a ferrite phase having a content of 65% by volume or more and an average grain size in the ferrite phase of 3.5 μm or less, and the content of the remainder of the steel structure except bainite is limited to 3% by volume.

A method for manufacturing the cold-rolled steel sheet will now be described.

Molten steel having compositions as described above is continuously cast to slabs. The slab, which may be cooled once or not is as starting steel material and, is reheated to 1200° C. or more and is subjected to hot rolling and subsequently cold rolling. Then, the obtained steel sheets are subjected to recrystallization annealing at a temperature in the range of $A_3$° C. to ($A_3$+30)° C. and are subsequently cooled to 600° C. or less at a rate of 5° C./s or more.

If the slab reheating temperature is lower than 1200° C., TiC and the like do not dissolve sufficiently and coarsen. Consequently, effects of increasing recrystallization temperature and the grain growth are suppressed and are not sufficient in a recrystallization annealing process afterward. Accordingly, the slab reheating temperature is set at 1200° C. or more.

The temperature at hot finish rolling exit side is not particularly limited, but, preferably, it is the $Ar_3$ transformation point or more because a temperature lower than the $Ar_3$ transformation point produces α and γ during rolling and, thus, a band structure is easily produced which will remain in the steel structure even after cold rolling and annealing, and causes anisotropy in the mechanical properties.

Coiling temperature after hot rolling is not particularly limited. However, AlN, which prevents aging degradation resulting from nitrogen, is not sufficiently produced at a temperature of lower than 500° C. or higher than 650° C., and mechanical properties are, consequently, degraded. Also, in order to uniformize the steel sheet structure and to uniformize and reduce the grain size of the structure as much as possible, the coiling temperature is, preferably, in the range of 500 to 650° C.

Preferably, oxidized scale on the surface of the hot-rolled steel sheet is removed by acid cleaning. Then, the steel sheet is subjected to cold rolling to obtain a cold-rolled steel sheet having a predetermined thickness. The conditions of acid cleaning and cold rolling are not particularly limited, and are according to common methods.

Preferably, the rolling reduction ratio is set at 40% or more from the viewpoint of increasing nucleation sites in recrystallization annealing to further reduce the grain size. In contrast, an excessively increased rolling reduction ratio brings about work hardening and, thus, operation becomes hard. Accordingly, the preferred upper limit of the rolling reduction ratio is 90% or less.

Next, the obtained cold-rolled steel sheet is heated to a temperature in the range of $A_3$° C. to ($A_3$+30)° C. to be subjected to recrystallization annealing.

Since temperature $A_3$ is equivalent to the recrystallization temperature in the steel material having the above-described composition, recrystallization does not sufficiently proceed at a temperature of lower than $A_3$. In contrast, a temperature of higher than ($A_3$+30) promotes γ grains grow significantly and is, therefore, not suitable for grain fining. Preferably, the recrystallization annealing is performed in a continuous annealing line and, preferably, the period of annealing time in the continuous annealing is 10 to 120 seconds for which recrystallization occurs. A period of less than 10 seconds does not sufficiently progress the recrystallization and allows a structure expanding in the rolling direction to remain, and thus satisfactory ductility are not obtained in some cases. In contrast, a period of more than 120 seconds increases the size of γ grains and, thus, a desired strength is not obtained in some cases.

The annealed steel sheet is subsequently cooled to 600° C. or less at a rate of 5° C./s or more. The cooling rate refers to an average rate for cooling from the annealing temperature to 600° C. A cooling rate of less than 5° C./s reduces the degree of undercooling in γ-to-α transformation during cooling and, thus, increases the grain size. Accordingly, the cooling rate from the annealing temperature to 600° C. needs to be 5° C./s or more.

Also, since grain fining is significantly affected by temperature down to 600° C. at which γ-to-α transformation is initiated, the cooling is terminated at 600° C. The secondary phase type (martensite, bainite, pearlite, or the like) may be separated by appropriately controlling the cooling rate in the region lower than 600° C.

When stretch flangeability is particularly required, the secondary phase, preferably, is bainite. For this purpose, the steel sheet is further cooled from 500 to 350° C. to be held at those temperatures for 30 to 400 seconds. If the period of cooling time is less than 30 seconds, the secondary phase is liable to turn to martensite and the martensite content is increased to 3% by volume or more. Thus the ductility and the strength difference between the ferrite and the secondary phase are increased and the stretch flangeability is degraded. If the period of cooling time is more than 400 seconds, the grains becomes larger and the secondary phase is liable to turn to brittle pearlite and the pearlite content is increased to 3% by volume or more. Thus the stretch flangeability is degraded.

Thus, the resulting cold-rolled steel sheet has an ultrafine grain structure and exhibits excellent strength-ductility balance, toughness, stretch flangeability.

EXAMPLES

Slabs each having a composition shown in Table 1 were re-heated under the conditions shown in Table 2, and were hot-rolled to form hot-rolled sheets having a thickness of 4.0 mm. The hot-rolled sheets were pickled and subsequently cold-rolled (rolling reduction rate: 60%) to form cold-rolled sheets having a thickness of 1.6 mm. The cold-rolled sheets were subjected to recrystallization annealing under the conditions shown in Table 2 to form final products.

The resulting final products were subjected to measurements for the micro structure, tensile properties, stretch flangeability, and toughness. The results are shown in Table 3.

For the measurement of the micro structure, the average grain size and area ratio of the ferrite in a section in the rolling direction of the steel sheet were measured by optical microscopy or scanning electron microscopy. The volume ratio was calculated from the area ratio. The grain size used herein is preferably the nominal size so expressed that a grain segment is measured by a linear shearing method of JIS G 0522. In this instance, etching of grain boundaries is preferably conducted for about 15 seconds by use of about 5% nitric acid in alcohol. The average grain size is determined by observing the steel sheet structure, in the longitudinal section, at 5 or more fields, at magnification of 1000 to 6000 and using an optical microscope or a scanning electron microscope (SEM), and by averaging each of the grain size obtained by the above linear shearing method.

The tensile properties (tensile strength TS and elongation EL) were determined through a tensile test using a JIS No. 5 test piece taken from the steel sheet in the rolling direction.

The stretch flangeability was determined through a hole expansion test. In the hole expansion test, a hole of 10 mm in diameter ($D_0$) was formed in a test piece taken in accordance with the technical standards of Japan Iron and Steel Federation JFST1001 and was subsequently expanded with a conical punch having a taper angle of 60°, and the hole diameter (D) was measured immediately after a fracture passes through the thickness of the test piece. The hole expansion ratio λ was defined by the following expression:

$$\lambda=[(D-D_0)/D_0]\times 100\%$$

The toughness was determined by measuring the ductile-brittle transition temperature vTrs (° C.) in accordance with JIS Z 2242, using a 2 mm V-notch Charpy specimen.

TABLE 1

| Steel symbol | Composition (mass %) | | | | | | | | | | | | |
|---|---|---|---|---|---|---|---|---|---|---|---|---|---|
| | C | Si | Mn | P | S | Al | N | Ni | Ti | Nb | Mn + Ni | Ti* + (48/93) [% Nb] | Other |
| A | 0.08 | 0.05 | 1.50 | 0.012 | 0.002 | 0.049 | 0.0030 | — | 0.050 | 0.030 | 1.50 | 0.052 | — |
| B | 0.08 | 0.10 | 1.70 | 0.012 | 0.002 | 0.045 | 0.0040 | — | 0.050 | 0.055 | 1.70 | 0.028 | — |
| C | 0.08 | 0.10 | 1.20 | 0.011 | 0.003 | 0.035 | 0.0030 | 1.00 | 0.050 | 0.045 | 2.20 | 0.023 | — |
| D | 0.08 | 0.40 | 1.80 | 0.010 | 0.002 | 0.044 | 0.0031 | — | 0.040 | — | 1.80 | 0.026 | — |
| E | 0.10 | 0.60 | 2.10 | 0.011 | 0.003 | 0.051 | 0.0030 | 1.00 | 0.050 | 0.040 | 3.10 | 0.056 | — |
| F | 0.05 | 0.11 | 1.60 | 0.015 | 0.004 | 0.030 | 0.0035 | — | 0.020 | 0.020 | 1.60 | 0.012 | — |
| G | 0.08 | 0.01 | 2.50 | 0.012 | 0.002 | 0.049 | 0.0030 | 2.00 | 0.102 | — | 4.50 | 0.089 | — |
| H | 0.10 | 0.20 | 2.50 | 0.015 | 0.002 | 0.040 | 0.0033 | — | 0.045 | 0.050 | 2.50 | 0.056 | Mo: 0.15 |
| I | 0.08 | 0.01 | 1.00 | 0.012 | 0.003 | 0.044 | 0.0033 | 0.70 | — | 0.040 | 1.70 | 0.021 | — |
| J | 0.07 | 0.20 | 1.70 | 0.009 | 0.002 | 0.051 | 0.0030 | — | 0.050 | — | 1.70 | 0.037 | — |
| K | 0.08 | 0.02 | 1.60 | 0.010 | 0.002 | 0.035 | 0.0025 | — | 0.050 | 0.030 | 1.60 | 0.054 | Cr: 0.1, Mo: 0.1 |
| L | 0.07 | 0.04 | 1.80 | 0.012 | 0.002 | 0.040 | 0.0030 | — | 0.050 | 0.030 | 1.80 | 0.052 | REM: 0.0008 |
| M | 0.08 | 0.05 | 1.80 | 0.012 | 0.002 | 0.049 | 0.0031 | — | 0.047 | 0.031 | 1.80 | 0.049 | Mo: 0.2, Ca: 0.0015 |
| N | 0.05 | 0.11 | 1.55 | 0.011 | 0.003 | 0.035 | 0.0033 | — | 0.020 | 0.005 | 1.55 | 0.007 | — |
| O | 0.08 | 0.60 | 1.51 | 0.020 | 0.002 | 0.044 | 0.0041 | — | 0.030 | 0.010 | 1.51 | 0.018 | — |
| P | 0.07 | 0.01 | 1.10 | 0.011 | 0.003 | 0.035 | 0.0031 | — | 0.040 | — | 1.10 | 0.025 | — |

| Steel symbol | Tx (° C.) | $A_3$ (° C.) | $A_1$ (° C.) | Remarks |
|---|---|---|---|---|
| A | 895 | 841 | 685 | Applicable |
| B | 777 | 839 | 680 | " |
| C | 752 | 819 | 673 | " |
| D | 768 | 852 | 681 | " |

TABLE 1-continued

| | | | | |
|---|---|---|---|---|
| E | 913 | 816 | 654 | " |
| F | 698 | 851 | 683 | " |
| G | 1075 | 746 | 613 | " |
| H | 916 | 813 | 659 | " |
| I | 739 | 824 | 684 | " |
| J | 819 | 847 | 682 | " |
| K | 903 | 836 | 682 | " |
| L | 895 | 835 | 676 | " |
| M | 881 | 831 | 677 | " |
| N | 671 | 852 | 685 | Comparative steel |
| O | 727 | 874 | 693 | " |
| P | 760 | 853 | 696 | " |

Ti*: [% Ti]-(48/32) · [% S]-(48/14) · [% N]
Tx: 637.5 + 4930{Ti* + (48/93) · [% Nb]}

TABLE 2

| | | | Recrystallization annealing conditions | | | | |
|---|---|---|---|---|---|---|---|
| No. | Steel symbol | Slab reheating temperature (° C.) | Annealing temperature (° C.) | Annealing time(s) (° C.) | Cooling rate from Annealing temp to 600° C. (° C./s) | Cooling time 500 to 350° C. (s) | Remarks |
| 1 | A | 1250 | 855 | 60 | 8 | 20 | Example |
| 2 | " | 1250 | 855 | 60 | 8 | 90 | " |
| 3 | B | 1250 | 850 | 60 | 15 | 120 | " |
| 4 | " | 1250 | 855 | 60 | 15 | 20 | " |
| 5 | " | 1250 | 845 | 60 | 15 | 460 | " |
| 6 | C | 1250 | 830 | 60 | 25 | 120 | " |
| 7 | D | 1230 | 865 | 60 | 15 | 150 | " |
| 8 | E | 1250 | 835 | 70 | 12 | 200 | " |
| 9 | " | 1250 | 820 | 60 | 10 | 300 | " |
| 10 | " | 1050 | 830 | 60 | 12 | 120 | Comparative Example |
| 11 | " | 1230 | 860 | 70 | 15 | 120 | Comparative Example |
| 12 | " | 1230 | 790 | 60 | 15 | 120 | Comparative Example |
| 13 | " | 1230 | 825 | 70 | 3 | 120 | Comparative Example |
| 14 | F | 1240 | 865 | 80 | 18 | 200 | Example |
| 15 | G | 1250 | 760 | 60 | 15 | 10 | " |
| 16 | " | 1250 | 760 | 60 | 15 | 150 | " |
| 17 | H | 1250 | 825 | 60 | 18 | 200 | " |
| 18 | I | 1240 | 839 | 70 | 14 | 120 | " |
| 19 | J | 1250 | 862 | 50 | 17 | 300 | " |
| 20 | K | 1240 | 850 | 60 | 8 | 120 | " |
| 21 | L | 1230 | 845 | 60 | 10 | 200 | " |
| 22 | M | 1250 | 845 | 60 | 12 | 120 | " |
| 23 | N | 1230 | 867 | 40 | 10 | 120 | Comparative Example |
| 24 | O | 1200 | 889 | 60 | 10 | 120 | Comparative Example |
| 25 | P | 1240 | 868 | 80 | 15 | 100 | Comparative Example |

TABLE 3

| | | Ferrite micro structure | | | Tensile properties | | | | | | |
|---|---|---|---|---|---|---|---|---|---|---|---|
| | | | | | | | | Stretch flangeability | | Toughness | |
| No. | Steel symbol | Average grain size (1 m) | Volume fraction (vol %) | Secondary phase** | Tensile strength TS (MPa) | Elongation EL (%) | TS × EL (MPa · %) | Hole extention ratio λ (%) | TS × λ (MPa · %) | Charpy transition temperature vTrs (° C.) | Remarks |
| 1 | A | 3.1 | 90 | M | 640 | 31 | 19840 | 75 | 48000 | <−140 | Example |
| 2 | " | 3.2 | 90 | B | 600 | 29 | 17400 | 110 | 66000 | <−140 | " |
| 3 | B | 2.8 | 93 | B | 620 | 28 | 17360 | 120 | 74400 | <−140 | " |
| 4 | " | 2.5 | 91 | M | 650 | 28 | 18200 | 55 | 35750 | <−140 | " |
| 5 | " | 3.4 | 95 | B(2%) + P(3%) | 590 | 30 | 17700 | 70 | 41300 | <−140 | " |
| 6 | C | 2.7 | 95 | B | 620 | 29 | 17980 | 110 | 68200 | <−140 | " |
| 7 | D | 2.9 | 75 | B | 700 | 27 | 18900 | 90 | 63000 | <−140 | " |

TABLE 3-continued

| | | Ferrite micro structure | | | Tensile properties | | | | | | |
|---|---|---|---|---|---|---|---|---|---|---|---|
| | | Average | | | Tensile | | | Stretch flangeability | | Toughness | |
| No. | Steel symbol | grain size (1 m) | Volume fraction (vol %) | Secondary phase** | strength TS (MPa) | Elongation EL (%) | TS × EL (MPa · %) | Hole extention ratio λ (%) | TS × λ (MPa · %) | Charpy transition temperature vTrs (° C.) | Remarks |
| 8 | E | 1.8 | 80 | B | 840 | 23 | 19320 | 75 | 63000 | <−140 | " |
| 9 | " | 1.7 | 80 | B | 800 | 24 | 19200 | 77 | 61600 | <−140 | " |
| 10 | " | 10.3 | 85 | B | 670 | 25 | 16750 | 40 | 26800 | −70 | Comparative Example |
| 11 | " | 7.5 | 80 | B | 680 | 24 | 16320 | 60 | 40800 | −90 | Comparative Example |
| 12 | " | * | * | B | 835 | 12 | 10020 | 50 | 41750 | −70 | Comparative Example |
| 13 | " | 6.8 | 85 | B | 670 | 23 | 15410 | 55 | 36850 | −90 | Comparative Example |
| 14 | F | 2.9 | 85 | B | 600 | 32 | 19200 | 100 | 60000 | <−140 | Example |
| 15 | G | 0.9 | 70 | M | 960 | 19 | 18240 | 42 | 40320 | <−140 | " |
| 16 | G | 0.9 | 80 | B | 950 | 19 | 18050 | 56 | 53200 | <−140 | " |
| 17 | H | 1.2 | 85 | B(13%) + M(2%) | 988 | 18 | 17784 | 53 | 52364 | <−140 | " |
| 18 | I | 1.9 | 85 | B | 620 | 31 | 19220 | 120 | 74400 | <−140 | " |
| 19 | J | 2.3 | 85 | B | 600 | 32 | 19200 | 110 | 66000 | <−140 | " |
| 20 | K | 2.9 | 85 | B | 720 | 27 | 19440 | 95 | 68400 | <−140 | " |
| 21 | L | 3.1 | 88 | B | 645 | 30 | 19350 | 115 | 74175 | <−140 | " |
| 22 | M | 2.7 | 85 | B | 680 | 29 | 19720 | 100 | 68000 | <−140 | " |
| 23 | N | 11.2 | 90 | B | 560 | 26 | 14560 | 50 | 28000 | −70 | Comparative Example |
| 24 | O | 9.3 | 85 | B | 630 | 25 | 15750 | 45 | 28350 | −70 | Comparative Example |
| 25 | P | 7.5 | 90 | B | 460 | 33 | 15180 | 60 | 27600 | −90 | Comparative Example |

*Incapable measure because of non-crystallized grains
**B: bainite, M: martensite, P: pearlite As shown in Table 3, the samples according to the present invention each have a ferrite content of 65% by volume or more and exhibit an average ferrite grain size of 3.1 μm or less, satisfying the required value of 3.5 μm or less. In particular, steel sheet Nos. 15 and 16 using steel G, in which the Ni and Mn contents are increased to significantly lower temperature $A_3$, have ultrafine grain structure having an average grain size of 0.9 μm.

The TS×EL values of the samples according to the present invention are each 17000 MPa·% or more, hence exhibiting excellent strength-ductility balance. Also, the ductile-brittle transition temperatures are −140° C. or less, thus exhibiting excellent toughness.

The remainder of the steel structure, other than the ferrite phase, was limited to less than 3% by volume except for bainite, and consequently, it is shown that the hole expansion formability was improved and, thus, the strength-hole expansion balance TS×λ was significantly increased to more than 50000 MPa·%.

In contrast, in steel sheet NO. 10, since the slab reheating temperature is low, TiC becomes coarse, thus suppressing the effect of increasing recrystallization temperature, so that the grain size of the resulting steel sheet is not reduced. Thus, the grain size is increased. The TS×EL value was also reduced.

In steel sheet No. 11, the annealing temperature is excessively increased beyond the preferred temperature (846° C.) of the present invention, and consequently, the grains grow significantly and the TS×EL value is reduced.

In steel sheet No. 12, the annealing temperature does not reach the preferred lower limit temperature (816° C.) of the present invention, and consequently, recrystallization is not completed to allow a deformed structure to remain. Thus, the TS×EL value is reduced and the ductile-brittle transition temperature is increased.

In steel sheet No. 13, the cooling rate after annealing is low, and consequently, the grain size is increased and thus the strength and the TS×EL value were degraded.

In steel sheet No. 23, the recrystallization temperature is lower than temperature $A_1$, and consequently, recrystallization annealing does not produce the effect of reducing the γ grain size. Thus, the grain size becomes large and satisfactory strength is not obtained.

In steel sheet No. 24, since temperature $A_3$ is 860° C. or more, high temperature annealing is needed. As a result, the grains grow and the TS×EL value is degraded.

In steel sheet No. 25, since the (Ni+Mn) content is low, the degree of undercooling in the γ-to-α transformation during cooling after annealing becomes low. As a result, ultrafine nucleation of a does not occur and, thus, the grain size becomes large.

While the present invention has been illustrated herein using preferred embodiments in which a cold-rolled steel sheet has been described, it will be readily appreciated by those skilled in the art that the present invention may be applied to steel sheets plated with zinc, tin, or the like after recrystallization annealing.

What is claimed is:

1. A cold-rolled steel sheet having an ultrafine grain structure including a ferrite phase, the cold-rolled steel sheet comprising:

0.03 to 0.16 mass percent of C;

2.0 mass percent or less of Si;

at least one of 3.0 mass percent or less of Mn and 3.0 mass percent or less of Ni;

at least one of 0.2 mass percent or less of Ti and 0.2 mass percent or less of Nb;

0.01 to 0.1 mass percent of Al;

0.1 mass percent or less of P;

0.02 mass percent or less of S;

0.005 mass percent or less of N; and

Fe and incidental impurities, wherein the ferrite phase has a content of 65 percent by volume or more and an average grain size of 3.5 μm or less, and the C, Si, Mn, Ni, Ti, and Nb satisfy expressions (1), (2), and (3):

$$637.5+4930(Ti^*+(48/93)\cdot[\%Nb])>A_1 \quad (1)$$

$$A_3<860 \quad (2)$$

$$[\%Mn]+[\%Ni]>1.3 \quad (3)$$

where $$Ti^*=[\%Ti]-(48/32)\cdot[\%S]-(48/14)\cdot[\%N];$$

$$A_1=727+14[\%Si]-28.4[\%Mn]-21.6[\%Ni];$$

$$A_3=920+612.8[\%C]^2-507.7[\%C]+9.8[\%Si]^3-9.5[\%Si]^2+68.5[\%Si]+2[\%Mn]^2-38[\%Mn]+2.8[\%Ni]^2-38.6[\%Ni]+102[\%Ti]+51.7[\%Nb];\text{ and}$$

[%M] represents element M content (mass %).

2. The cold-rolled steel sheet according to claim 1, wherein a remainder content of the steel sheet, other than the ferrite phase, is less than 3 percent by volume except for bainite.

3. The cold-rolled steel sheet according to claim 1, further comprising:

at least one of 1.0 mass percent or less of Mo, and 1.0 mass percent or less of Cr.

4. The cold-rolled steel sheet according to claim 1, further comprising at least one element selected from the group consisting of Ca, rare earth elements, and B in a total amount of 0.005 mass percent or less.

5. The cold-rolled steel sheet according to claim 3, further comprising at least one element selected from the group consisting of Ca, rare earth elements, and B in a total amount of 0.005 mass percent or less.

6. A method for manufacturing a cold-rolled steel sheet having an ultrafine grain structure, the method comprising:

heating a starting steel material to a temperature of 1200° C. or more;

hot-rolling the starting steel material;

cold-rolling the hot-rolled material;

performing recrystallization annealing at a temperature in the range of $A_3$° C. to ($A_3$+30)° C.; and cooling the annealed material to 600° C. or less at a rate of 5° C./s or more, wherein the starting steel material comprises:

0.03 to 0.16 mass percent of C;

2.0 mass percent or less of Si;

at least one of 3.0 mass percent or less of Mn and 3.0 mass percent or less of Ni;

at least one of 0.2 mass percent or less of Ti and 0.2 mass percent or less of Nb;

0.01 to 0.1 mass percent of Al;

0.1 mass percent or less of P;

0.02 mass percent or less of S;

0.005 mass percent or less of N; and

Fe and incidental impurities, and wherein the C, Si, Mn, Ni, Ti, and Nb satisfy expressions (1), (2), and (3):

$$637.5+4930(Ti^*+(48/93)\cdot[\%Nb])>A_1 \quad (1)$$

$$A_3<860 \quad (2)$$

$$[\%Mn]+[\%Ni]>1.3 \quad (3)$$

where $$Ti^*=[\%Ti]-(48/32)\cdot[\%S]-(48/14)\cdot[\%N];$$

$$A_1=727+14[\%Si]-28.4[\%Mn]-21.6[\%Ni];$$

$$A_3=920+612.8[\%C]^2-507.7[\%C]+9.8[\%Si]^3-9.5[\%Si]^2+68.5[\%Si]+2[\%Mn]^2-38[\%Mn]+2.8[\%Ni]^2-38.6[\%Ni]+102[\%Ti]+51.7[\%Nb];\text{ and}$$

[%M] represents element M content (mass %).

7. The method for manufacturing the cold-rolled steel sheet according to claim 6, further comprising further cooling the cooled material from 500 to 350° C. for a period of time in the range of 30 to 400 s, after the step of cooling the annealed material to 600° C. or less.

8. The method for manufacturing the cold-rolled steel sheet according to claim 6, wherein the starting steel material further comprises at least one of 1.0 mass percent or less of Mo and 1.0 mass percent or less of Cr.

9. The method for manufacturing the cold-rolled steel sheet according to claim 6, wherein the starting steel material further comprises at least one element selected from the group consisting of Ca, rare earth elements, and B in a total amount of 0.005 mass percent or less.

10. The method for manufacturing the cold-rolled steel sheet according to claim 8, wherein the starting steel material further comprises at least one element selected from the group consisting of Ca, rare earth elements, and B in a total amount of 0.005 mass percent or less.

11. The cold-rolled steel sheet according to claim 2, further comprising:

at least one of 1.0 mass percent or less of Mo, and 1.0 mass percent or less of Cr.

12. The cold-rolled steel sheet according to claim 2, further comprising at least one element selected from the group consisting of Ca, rare earth elements, and B in a total amount of 0.005 mass percent or less.

13. The method for manufacturing the cold-rolled steel sheet according to claim 7, wherein the starting steel material further comprises at least one of 1.0 mass percent or less of Mo and 1.0 mass percent or less of Cr.

14. The method for manufacturing the cold-rolled steel sheet according to claim 7, wherein the starting steel material further comprises at least one element selected from the group consisting of Ca, rare earth elements, and B in a total amount of 0.005 mass percent or less.

* * * * *